US007828902B2

(12) United States Patent
Kinnaird et al.

(10) Patent No.: US 7,828,902 B2
(45) Date of Patent: Nov. 9, 2010

(54) SODIUM-FREE, LITHIUM-CONTAINING CONCRETE CLEANING COMPOSITIONS AND METHOD FOR USE THEREOF

(75) Inventors: Michael Gates Kinnaird, Durham, NC (US); David Linith Rigsbee, Durham, NC (US)

(73) Assignee: Chemtek, Inc., Yanceyville, NC (US)

( * ) Notice: Subject to any disclaimer, the term of this patent is extended or adjusted under 35 U.S.C. 154(b) by 0 days.

(21) Appl. No.: 12/029,244

(22) Filed: Feb. 11, 2008

(65) Prior Publication Data

US 2008/0127995 A1 Jun. 5, 2008

Related U.S. Application Data

(62) Division of application No. 10/921,204, filed on Aug. 19, 2004, now abandoned.

(51) Int. Cl.
*B08B 7/00* (2006.01)
*B08B 3/00* (2006.01)

(52) U.S. Cl. ..... 134/2; 134/42

(58) Field of Classification Search ..... 510/240, 510/421, 426, 427, 432, 434, 435, 467, 480, 510/506; 134/2, 4, 40
See application file for complete search history.

(56) References Cited

U.S. PATENT DOCUMENTS

| | | | | |
|---|---|---|---|---|
| 4,000,082 | A | 12/1976 | Otrhalek et al. | |
| RE29,473 | E | 11/1977 | Fitzgerald, Jr. et al. | |
| 4,057,505 | A | 11/1977 | Nakagawa et al. | |
| 4,157,921 | A | 6/1979 | Baturay et al. | |
| 4,521,249 | A | 6/1985 | Obitsu et al. | |
| 4,559,241 | A | 12/1985 | Obitsu et al. | |
| 4,569,782 | A | 2/1986 | Disch et al. | |
| 4,576,743 | A | 3/1986 | Kita et al. | |
| 4,772,426 | A | 9/1988 | Koch et al. | |
| 5,021,260 | A | 6/1991 | Kitagawa et al. | |
| 5,723,095 | A | 3/1998 | Fricker et al. | |
| 5,750,276 | A | 5/1998 | Page | |
| 5,834,411 | A * | 11/1998 | Bolkan et al. | 510/245 |
| 5,837,315 | A | 11/1998 | Foltz et al. | |
| 5,951,784 | A * | 9/1999 | Hawes | 134/40 |
| 5,954,891 | A | 9/1999 | Kondoh et al. | |
| H1818 | H | 11/1999 | Potgieter et al. | |
| 5,985,011 | A | 11/1999 | Foltz et al. | |
| 6,303,017 | B1 | 10/2001 | Page et al. | |
| 6,454,632 | B1 * | 9/2002 | Jones et al. | 451/28 |
| 6,855,678 | B2 | 2/2005 | Whiteley | |
| 2003/0004079 | A1 * | 1/2003 | Aigner et al. | 510/240 |
| 2003/0089381 | A1 * | 5/2003 | Manning, Jr. | 134/1 |
| 2005/0245420 | A1 * | 11/2005 | Lewis et al. | 510/407 |

FOREIGN PATENT DOCUMENTS

| | | |
|---|---|---|
| DE | 101 28 894 | * 12/2002 |
| JP | 6-33016 | * 2/1994 |
| WO | WO 03/080787 | * 10/2003 |

* cited by examiner

*Primary Examiner*—Michael Kornakov
*Assistant Examiner*—Stephen Ko
(74) *Attorney, Agent, or Firm*—Alston & Bird LLP

(57) ABSTRACT

Compositions for cleaning concrete or other cementitious substrates that do not contribute to the alkali-silicate reaction are provided, and methods for use thereof The cleaning compositions comprise lithium salts such as lithium hydroxide, lithium oxide and/or lithium carbonate, at least one surface active agent, optionally a glycol ether and/or hydrocarbon solvent, a sodium-free or substantially sodium-free chelating agent or agents and/or one or more adjuncts at least partially contributing to the useful properties of the composition.

29 Claims, No Drawings

SODIUM-FREE, LITHIUM-CONTAINING CONCRETE CLEANING COMPOSITIONS AND METHOD FOR USE THEREOF

CROSS-REFERENCE TO RELATED APPLICATIONS

The present application is a divisional of U.S. patent application Ser. No. 10/921,204, filed Aug. 19, 2004, now abandoned which is incorporated herein by reference in its entirety.

FIELD OF THE INVENTION

This invention relates generally to compositions for cleaning concrete or other cementitious substrates that do not contribute to the alkali-silicate reaction, and methods for use thereof

BACKGROUND OF THE INVENTION

Concrete and other cementitious materials contain aggregate typically stone and/or sand, and a binder, usually produced utilizing lime (calcium oxide) and other components that react with water to form a highly-networked solid when the resultant mass has cured. Calcium oxide, being highly alkaline, imparts alkalinity to the resulting water slurry. The pH of this slurry is typically over 12. As such, there is the possibility to react the residual or infiltrated water in the resultant concrete or cementitious mass (hereinafter "concrete" or "structure"), and amorphous silica in the aggregate used to make the structure. This reaction is called the alkali-silicate reaction, hereinafter sometimes referred to as "ASR". The products of this reaction can absorb or release water, causing expansion and contraction in the concrete. If the expansion forces are locally greater than the cohesive forces in the concrete binder, then cracking results.

This cracking can be devastating to the usefulness of the structure, as in the case, for example of concrete roads and bridges. The resulting damage can drastically shorten the lifetime of the structure, causing millions of dollars in economic loss each year. Therefore, means to control, stop and/or remediate this damage have been highly sought after. Likewise, the factors that contribute to the damage have been sought after, so as not to make a bad situation worse.

Some of the major factors that contribute to ASR have been found to be the addition of water to the microscopic pores in the concrete binder, the presence of amorphous silica in the aggregate or sand added prior to mixing with water, and sources of additional alkalinity, such as alkaline cleaning solutions.

This latter factor is a source of much consternation when ASR is occurring in a concrete structure that needs periodic cleaning, such as a road, bridge or parking lot. In that situation, it is possible that the cleaning operation, while improving the appearance of the concrete, might hasten its' demise.

This is because one of the major groups of cleaning compositions, highly-utilized in the cleaning industry, especially where concrete is the substrate that is being cleaned, involve alkaline solutions. Alkalinity, often in the form of phosphates, silicates, carbonates, oxides and/or hydroxides of sodium or potassium are highly-useful to "build" up the cleaning power of cleaning compositions. They have the added advantage of being relatively inexpensive. Therefore, means of cleaning concrete utilizing alkaline cleaning compositions are very desirable if concrete that is suffering from ASR is to be cleaned.

One means that has been found to control or remediate ASR is to expose the concrete surface to lithium-containing compositions. A number of patents have been issued in the area of lithium-containing compositions and methods of utilizing them to control or remediate ASR, and these are discussed below. However, as will be shown, none of them disclose useful compositions to clean concrete structures, so compositions and/or methods of cleaning concrete structures that do not contribute to ASR are still desired.

PRIOR ART

U.S. Pat. No. 6,303,017 (Page, et al.)

Page teaches a method of cathodically protecting the reinforcement of concrete structures, involving a sacrificial anode and an alkaline solution to dissolve the anode, preferably utilizing lithium hydroxide, as this material will not only help the anode dissolve, but will act as an inhibitor for the alkali-silica reaction ("ASR").

U.S. Pat. Nos. 5,837,315 and 5,985,011 (Foltz, et al.)

These related patents teach compositions (U.S. Pat. No. 5,985,011) and processes (U.S. Pat. No. 5,837,315) for controlling or remediating damage to concrete due to ASR. The compositions comprise lithium salts (other than lithium silicate), and surface tension reducing agents which allow the solutions to penetrate further into the concrete than the lithium-containing solutions alone would. However, neither disclosure teaches that any such composition is able to clean concrete, nor is a cleaning process envisioned, due to the fact that the compositions are applied but never removed by rinsing or some other related process. The sole purpose of the surface active agent is to aid the lithium-containing material to penetrate deeper into the concrete. Therefore, although the compositions are admirable in their ability to control or remediate damage to concrete, they will not be useful as cleaning agents. Therefore, a cleaning composition that will perform a similar function with regards to control of ASR is desirable.

U.S. Pat. No. 5,750,276 (Page)

Page teaches a method for inhibiting the alkali-silicate reaction in concrete structures, which utilizes lithium compounds in repair concretes, grouts or mortars. Presumably the increased lithium concentration in the added cementitious material will allow diffusion of lithium into the pre-existing structure, aiding it in resisting ASR U.S. Pat. No. 5,021,260 (Kitagawa)

Kitagawa teaches a method of preventing the deterioration of concrete due to ASR by impregnating the concrete with a solution of an alkali metal or alkaline earth metal and an organic silicon compound, among other embodiments, and the applied material is allowed to dry in the air. However, this method is not useful for cleaning, and the major innovation involves the organic silicon-containing material, which presumably forms a seal against exterior moisture. Lithium is only one of many possible metal components useful in the method.

U.S. Pat. No. 4,772,426 (Koch, et al.)

Koch teaches concentrates useful for cleaning hard surfaces when diluted, utilizing among others, an ester-sulfonate-containing surfactant, which can utilize lithium as the counterion for the anionic portion of the surfactant sulfonate. However, no alkaline builders were utilized in the Koch invention. Therefore, relatively more of the expensive surface active agents must be used to achieve a good cleaning effect on many soils, so a stronger-acting cleaning composition is preferable.

U.S. Pat. No. 4,569,782 (Disch, et al.)

Disch teaches that a novel fatty acid cyanamide, along with other, unspecified secondary surfactants and/or builders, etc. is useful for cleaning hard surfaces. One of the metals that can be utilized as the counterion for the cyanamide is lithium. However, ASR is not mentioned in the teachings, nor is a sodium-free system envisioned. Therefore, an alkaline cleaning composition that utilizes lithium solely is preferable.

U.S. Pat. No. 4,559,241 (Obitsu, et al.)

Obitsu teaches an agent and method for protecting concrete structures from ASR by utilizing a combination of an alkaline silicate solution and a nitrite salt. One of the silicates claimed is lithium silicate. However, the solubility of lithium silicate is exceedingly low in water, so the amount of lithium delivered by this means will be rather negligible. Also, no mention is made of any cleaning effect. Therefore, a cleaning solution with better properties is desired.

U.S. Pat. No. 4,521,249 (Obitsu, et al.)

Obitsu teaches an agent and method for protecting concrete structures from ASR by utilizing a combination of an alkaline silicate solution and a sodium naphthalenesulfonate-formaldehyde condensate. The presence of the condensate allows the silicate solution to penetrate more deeply. One of the silicates claimed is lithium silicate. However, the solubility of lithium silicate is exceedingly low in water, so the amount of lithium delivered by this means will be rather negligible. Also, the presence of sodium is detrimental to the helpful action of any lithium salts present in the mixture. Also, no mention is made of any cleaning effect. Therefore, a cleaning solution with better properties is desired.

U.S. Pat. No. H1,818 (Potgeiter, et al.)

Potgeiter teaches a detergent or cleaning composition comprising a broad range of surfactants, including especially a detergent alcohol ethoxylate or derivative thereof which is prepared by a combination process such that some of the alcohol(s) will be linear, i.e. with little branching in the carbon skeleton, some will be branched, but the amount of branching can be less than that usually produced by an oxo process, but more than that produced by the Fischer-Tropsch process. Lithium among other metal counterions is a potential counterion for some of the derivatives of the alcohol, but no mention is made of the effect, if any, of the compositions on concrete, and there is no restriction as to the sodium or potassium content due to the other cleaning composition components. Therefore, a more concrete-friendly cleaner is desirable.

It is the purpose of this disclosure to teach compositions and methods of use thereof that will not only be substantially or completely sodium-free, containing substantially or only lithium as an inorganic cation, and therefore will not contribute to ASR, but will also clean dirt, oil or grease, rubber or other soils off of concrete, or remove paint therefrom.

SUMMARY OF THE INVENTION

According to this invention a substantially or completely sodium-free cleaning composition containing substantially or only lithium as an inorganic cation, said composition capable of removing dirt, grease, oil, paint, and/or rubber from concrete that does not contribute to alkali-silicate reaction, consisting essentially of:

a. Lithium hydroxide (and/or its' hydrate), lithium oxide, lithium carbonate, or a lithium salt with a solubility in water of greater than 0.5 percent by weight and a resulting pH of greater than 7, with the amount of any/all such salts (on an anhydrous basis) combined being about 0.1 to about 99 percent by weight of the total cleaning composition, b. At least one surfactant, in the amount of about 0.1 to about 90 percent by weight of the total cleaning composition, said surfactant(s) being selected from the group containing nonionic, cationic, acid-form anionic surfactants and/or their lithium salts, acid-form amphoteric surfactants and/or their lithium salts, and zwitterionic "inner salt" amphoteric surfactants, c. A solvent or solvent combination, in the amount of about 0 to about 50 percent by weight of the total cleaning composition, being at least one solvent selected from the group containing i. A "glycol ether" solvent or mixture of solvents, containing at least one alkylene-oxide-derived component selected from the group containing ethylene-, propylene-, butylene- and isobutylene oxides, said glycol ether(s) containing at least one terminal alkyl chain selected from the group containing the alkyl chains methyl-, ethyl-, propyl-, butyl-, isobutyl-, pentyl-, isopentyl-, neopentyl and other straight-chain or branched hydrocarbons with carbon number in the range from 6 to about 12, said glycol ether being exemplified by 1-butoxy-2-hydroxy ethanol, ii. A hydrocarbon solvent or mixture of solvents, being at least one selected from the group containing aliphatic, aromatic, and unsaturated aliphatic solvents i.e. alkenes, each such hydrocarbon solvent containing from about 6 to about 60 carbon atoms, iii. alcohols, which can be aliphatic, aromatic or unsaturated, containing from about 3 to about 60 carbon atoms, with the proviso that the alcohol is stable in the alkaline solutions of the instant invention, iv. ethers, which can be aliphatic, aromatic or unsaturated, containing from about 3 to about 60 carbon atoms, with the proviso that the ether is stable in the alkaline solutions of the instant invention, v. Or combination solvents, wherein the solvent contains a combination of one or more alcohol and/or ether group, and is aliphatic, aromatic, aliphatic/aromatic, unsaturated aliphatic and/or aliphatic/aromatic, containing from about three to about 60 carbon atoms, d. A completely- or largely sodium-free or chelating agent or agents in the amount of about 0 to about 30 percent by weight of the total cleaning composition, such chelating agents containing numerically less than 25% of their cations being other than lithium and/or hydrogen, and/or the total presence of a sodium-chelating agent being present in an amount of less than 0.5% by weight; and e. One or more adjuncts at least partially contributing to the useful properties of the composition, being selected from the group containing scale-control or dispersant polymers, phosphonate or related scale control agents, cellulose-derived or synthetic polymeric thickeners, abrasives, solid carriers, colorants and odorants.

The exact proportions and choice of components of the composition chosen will depend on what the soil is that is being removed. In general, oil and dirt can be removed with lower proportions of alkaline substances than can rubber or paint. Likewise, the amount(s) and type(s) of solvent(s) will be determined by similar considerations. Some soils, such as grease and oil, can be removed with or without solvents, depending on the nature and type of surface active agents chosen, and the desires of the particular customer to use or not use cleaners that contain volatile organic carbons ("VOC"s). However, paint and rubber generally require the presence of solvents as well as alkalinity and surface active agents to remove them.

Likewise the exact time of contact and mode of use is dependent on various considerations. In particular, the stronger the solution, in general, the less contact time or additional force in the form of scrubbing or pressurized water rinse is required to effect cleaning.

It is to be understood that commercially speaking, some surface active agents or adjuvants may not be available as their free acids or lithium salts. In situations where such surface active agents or adjuvants may not be commercially available in the appropriate form but nonetheless be deemed important or critical for overall cleaner performance, a minor amount of sodium may be tolerated. However, this is obviously not a preferable situation. Furthermore, due to the presence in the market place of various nonionic, cationic, amphoteric or anionic surfactants, the latter two in their acid forms, it is possible currently to formulate a completely sodium-free formulation that contains only lithium as the sole inorganic cation. Such formulations are obviously preferable.

DETAILED DESCRIPTION OF THE INVENTION

The instant invention has as a critical component a source of alkalinity containing substantially or only lithium as the sole inorganic cation. The alkalinity source is commonly called a "builder", as it "builds" the cleaning power of the other components of the cleaning composition. Such alkalinity sources must be soluble in water to an extent that they contribute substantially to the cleaning. In general, this means that the solubility in water at room temperature is 0.5% or greater. This also generally means that the salt must be of a sufficiently weak acid that the resultant solution has a pH of 7 or greater. Furthermore, to be useful, the salt must be present in efficacious amounts. The exact amount will depend on the nature and concentration of the soil on the surface of the concrete structure, as well as the other formulation components, but the combined amount of any/all such salts (on an anhydrous basis) will generally need to be from about 0.1 to about 99 percent by weight of the total cleaning composition.

The preferred embodiments of such alkaline salts are lithium hydroxide, lithium oxide, lithium carbonate. The preferred range of such salts in the cleaning composition is from about 1 to about 10 percent of the total formulation, on an anhydrous basis.

Also of critical importance to the instant invention is the presence of at least one surface active agent ("surfactant"). The surfactant(s) help the builders break the bonds of the soil to the concrete substrate, and emulsify or suspend the resultant freed soil, and preferably also prevent the freed soil from re-attaching itself to the concrete elsewhere, the latter process being called "re-soiling". Surfactants should be present in quantities from about 0.1 to about 90% by weight of the whole formulation.

The exact nature and concentration of the surfactant(s) will depend on the type and concentration of soil(s), as well as the type and concentration of the other formulation components. In general, the presence of solvents may allow the use of less surfactant(s).

Ironically, however, the presence of solvents, especially in combination with nonionic surfactants, may cause the mixture to become unstable, resulting in two or more phases, generally considered to be a most unsatisfactory situation. In such situations, the presence of one or more "coupling" agents to re-combine or "couple" the formulation together may be necessary. As a general rule, these are anionic in nature. Typical coupling agents that find utility in the instant invention are salts (preferably lithium salts) of toluene sulfonic acids, xylene sulfonic acids, naphthalene- or alkylnaphthalene sulfonic acids, amphoteric surfactants such as imidazoline-based amphopropionic or amphodipropionic acids, or diphenyl oxide disulfonic acids, or the alkyl- or alkylaryl phosphoric or polyphosphoric acids. In the instant invention, the preferable form is the lithium salts. One method of adding the lithium salt is to add an excess of lithium alkalinity to the formulation, followed by the acid form of the anionic coupling agent. Other anionic or amphoteric coupling agents such as alkyl betaines, glycinates, sultaines, cinnamates, etc. can be used to advantage as well, but some of them, such as the betaines or glycinates typically contain excess sodium ions from their production processes, and so are not preferred. Occasionally, amine oxides, which can be considered as nonionic or zwitterionic can be used.

In a preferred embodiment, the anionic coupling agents are selected from the group containing alkylaryl sulfonates having alkyl chains of less than 9 carbon atoms long, and amphoteric surfactants with an alkyl chain length of 6-26 carbon atoms, alkyl or alkylaryl esters of phosphoric or polyphosphoric acid, any and all such coupling agents having lithium as the sole counterion, optionally having been produced during the production process for the cleaning composition by addition of extra lithium-containing alkaline materials, and then the acid form of the anionic coupling agent.

The phosphate esters mentioned above have the structure $\{X(O—R)_m—O\}_q—P(=O)(OM)_{(2-q)}$, wherein m is an integer from 0 to 20, OR is the reaction product of an alcohol and one or more alkylene oxides selected from the group containing ethylene, propylene, butylene and isobutylene oxides, and M is hydrogen or lithium, and X is methylene, benzene, naphthalene or an alkyl or dialkyl benzene or naphthalene with the structure $\{CH3[CH2]_n\text{-}\}_r X$ where n and r are independently integers from about zero to four for r, and 1 to about 40 for n. Polyphosphoric acid esters are similar, but have a polyphosphate structure $(P(=O))\text{-}\{O—P(=O))\}_s$, where s is 1 or greater.

Examples of the phosphate esters that find utility in the instant invention are phosphate esters of nonylphenol ethoxylates having a degree of ethoxylation from about 3 to about 15, or lauryl alcohol ethoxylate or ethoxy-propoxylate, having a degree ethoxylation or ethoxy/propoxylation from about 3 to about 15.

The exact amount of anionic coupling agent or agents necessary will vary depending on the exact formulation components and their levels in the formulations. Typically, from 0.1 to about 30 weight percent of such coupling agents will be required when they are needed. In a preferred embodiment, the amount is from about 0.5 to about 15 percent coupling agent or agents, when they are used.

Very few cleaning compositions do not include surface active agents ("surfactants"). In general, as mentioned above, those of the instant invention will require from about 0.1 to about 90 percent by weight to be present in the formulation. In a preferred embodiment, the composition contains from about 1 to about 30 percent surfactant. The type(s) utilized will depend on the specific cleaning requirements.

Nonionic surfactants are frequent primary surfactants in cleaning compositions utilized for cleaning concrete. A typical nonionic surfactant consists of an alkyl- or an alkyl-aryl chain with an alcohol or amino group, such as dodecyl alcohol, nonylphenol or tallow amine, and a portion containing groups derived by the reaction between the alkylene oxides, such as ethylene oxide, propylene oxide, butylene oxide or isobutylene oxide. More typically, the alkylene oxide is ethylene or propylene oxide or mixtures of these, and most typically, the alkylene oxide is ethylene oxide.

The nonionic surfactants that have utility in the instant invention typically are polyether alcohols, having alkyl chain lengths from about 6 to about 60 carbon atoms, may contain one or more alkyl chain, and sometimes be attached to one or more aromatic rings. In general, the nonionic surfactant must have 1% cloud point in the range of 32-212 degrees Fahrenheit. Examples of the alkyl(alkyaryl) groups that are useful in cleaning compositions according to the instant invention include nonyl-, dinonyl-, octyl-, or tridecylphenols, and/or straight-chain or branched chain aliphatic alcohols with a carbon number from about 6 to about 50. The surfactants that find utility in the instant invention are ethoxylates or mixed ethoxy-propoxylates of the alkyl (alkylaryl) alcohol groups listed above, or surfactants where the alcohol group has been replaced with an amino group or groups. The number of alkylene oxide groups should preferably be from about 1 to about 100, most preferably from about 6 to about 15. It is to be understood that other nonionic surfactants can be utilized as well, for example trialkyl amine oxides, or the alkyl polyglycosides (and/or glucosides). In a preferred embodiment, the nonionic surfactant is present in an amount from about 1 to about 5 percent of the formulation.

Another class of nonionic surfactants that can find application in the instant invention, although not preferable from an environmental perspective, are fluorocarbon-based ethoxylated nonionic surfactants, having a fluoroalkyl chain length from about 6 to about 20 carbon atoms. Examples of these are Zonyl FSN and Zonyl FSO fluorocarbon surfactants by E.I. DuPont de Nemours, Inc.

Some surfactants are better at removing certain soils than others. Some anionic surfactants, for example are especially good at removing oily or greasy soils from concrete, especially in combination with nonionic surfactants. Examples of such anionic surfactants that find utility in the instant invention are sulfonate esters, such as the alkyl sulfonates or alkylaryl sulfonates, exemplified by lithium lauryl sulfate or lithium dodecylbenzene sulfonate. Other anionic surfactants are exemplified by fatty acids, "interrupted soaps" which are alkyl sarcosines, and taurates. It is expected that anionic surfactants with between 6 and 60 carbon atoms will be useful. The main criteria for usefulness are that the anionic surfactant should have substantially or only lithium as the counterion after addition to the composition, and be stable in the resulting alkaline solution, having a pH of 7 or greater. In a preferred embodiment, the anionic surfactant is present in an amount from about 1 to about 5 percent of the formulation when present.

Another class of anionic surfactants that can find application in the instant invention, although not preferable from an environmental perspective, are fluorocarbon-based anionic surfactants, having a fluoroalkyl chain length from about 6 to about 20 carbon atoms. Examples of these are Zonyl FSP and Zonyl UR fluorocarbon surfactants by E.I. DuPont de Nemours, Inc.

Just as some anionics are particularly adept at removing some soils, cationic surfactants are particularly adept at removing others, also especially in combination with nonionic surfactants. Like nonionic surfactants, cationic surfactants typically contain no inorganic counterions. Therefore cationic surfactants are a preferred embodiment of this invention. Representative examples of cationic surfactants that find utility in the instant invention include, but are not limited to, alkyl trimethyl ammonium chlorides, acetates, etc., benzyl alkyl dimethyl ammonium chlorides, acetates, etc., alkylaryl benzyl dimethyl ammonium chlorides, acetates, etc., methyl bis(hydroxyethyl) alkyl ammonium chlorides, acetates, etc. Other cationic surfactants can also be utilized in the instant invention, this list is representative, not exhaustive. In a preferred embodiment, the cationic surfactant is present in an amount from about 1 to about 15 percent of the formulation when it is present.

Another class of cationic surfactants that can find application in the instant invention, although not preferable from an environmental perspective, are fluorocarbon-based cationic surfactants, having a fluoroalkyl chain length from about 6 to about 20 carbon atoms. An example of this type of surfactant is Zonyl FSD fluorocarbon surfactant by E.I. DuPont de Nemours, Inc.

Typically, for many cleaning applications, the cleaning power of the composition is greatly improved by the addition of organic solvents, such as hydrocarbons and/or glycol ethers. The solvent or solvent combination is typically present in the amount of about 0 to about 50 percent by weight of the total cleaning composition, such solvents being at least one solvent selected from the group containing:

a. A "glycol ether" solvent or mixture of solvents, containing at least one alkylene-oxide-derived component selected from the group containing ethylene-, propylene-, butylene- and isobutylene oxides, said glycol ether(s) containing at least one terminal alkyl chain selected from the group containing the alkyl chains methyl-, ethyl-, propyl-, butyl-, isobutyl, pentyl-, isopentyl-, neopentyl, hexyl, isohexyl, neohexyl, 2-ethylhexy, and other straight-chain or branched hydrocarbons, in general having a carbon number in the range from 1 to about 12. An example of such a glycol ether is 1-butoxy-2-hydroxy ethanol, b. A hydrocarbon solvent or mixture of solvents, being at least one selected from the group containing aliphatic, aromatic, and unsaturated aliphatic solvents i.e. alkenes, each such hydrocarbon solvent containing from about 6 to about 60 carbon atoms, a preferred example of such a hydrocarbon solvent being d-limonene, c. alcohols, which can be aliphatic, aromatic or unsaturated, containing from about 3 to about 60 carbon atoms, with the proviso that the alcohol is stable in the alkaline solutions of the instant invention, an example of which is isopropanol, d. ethers, which can be aliphatic, aromatic or unsaturated, containing from about 3 to about 60 carbon atoms, with the proviso that the ether is stable in the alkaline solutions of the instant invention, and example of which is diphenyl ether, e. Or combination solvents, wherein the solvent contains a combination of one or more alcohol and/or ether group, and/or is aliphatic, aromatic, aliphatic/aromatic, unsaturated aliphatic and/or aliphatic/aromatic, containing from about three to about 60 carbon atoms, an example of which is furfuryl alcohol. Furfuryl alcohol in particular finds utility in paint strippers.

A particular problem with many cleaning formulations, especially those containing anionic surfactants, but also in general when cleaning concrete, is the deleterious effect of water hardness (typically calcium) ions on the spent cleaning solution prior to or during the rinse phase of the cleaning process. One way of dealing with the presence of water hardness ions is to add chelating agents, which complex water hardness ions both in the formulation itself, and/or on the concrete surface.

The instant invention benefits from such chelating agents, for the which it would obviously be preferable if they are either free acids or lithium salts. The exact amount of chelating agent will be determined by the exact requirements of the formulation and substrate to be cleaned, but typically these must be present in an amount from about 0.1 percent by weight to about 30 percent by weight.

Examples of such chelating agents include but are not limited to ethylenediamine tetra-acetic acid, ethylenediamine tri-acetic acid, gluconic acid, erythorbic acid, ascorbic acid, citric acid, boric acid, pyroboric acid, polyboric acid, anhydrous boric acid, ammonium pentaborate, and certain phosphoric acid derivatives such as pyrophosphoric acid, sodium acid pyrophosphate, tripoly phosphoric acid and/or their partial or complete lithium salts, and/or mixtures and/or combinations of these.

Note that if the chelating agent is to be used only to stabilize the formulation itself, an efficacious amount could be as low as 0.05-0.1% by weight. In such a situation, the presence of a sodium salt, such as is the case with sodium acid pyrophosphate or tetrasodium EDTA would not adversely affect the essentially sodium-free nature of the formulation as a whole. In that situation, a sodium or partial sodium salt would be acceptable. However, the amount of chelating agent(s) in that situation would need to be lower than if it (they) contained no sodium Therefore, this is definitely not a preferred embodiment. In such a non-preferred embodiment, the maximum amount of such sodium-containing chelating agent should be less than 0.5%, or as is the case with sodium acid pyrophosphate, no more than 25% of the cations are other than lithium or hydrogen.

Other ingredients may find utility in the instant invention, for special purposes. Examples of such optional adjuvants are thickeners, abrasives, zeolite softeners, scale control polymers such as polyacrylates, polymaleates, phosphinocarboxylates, typically in the 1000-500,000 MW range, preferably as free acids and/or lithium salts, co-polymers of these and/or other specialty monomers also preferably as free acids and/or lithium salts, and an example of which is the "AA-AMPS" type of polymer, sold as Buckman Industries product BSI 78; polyacrylic acid homopolymers such as BSI-97, polymaleic acid homopolymers such as Brisperse 891 manufactured by Rhodia Corporation, poly-vinylpyrrolidone polymers such as Sokolan HP-53 by BASF Corporation, phosphinocarboxylic acid polymers such as Bricorr 288, also manufactured by Rhodia corporation, as well as co-polymers, ter-polymers and other specialty polymers, phosphonate scale control agents such as hydroxy-ethylidine diphosphonic acid ("HEDP"), phosphonobutyl-tricarboxylic acid ("PBTC") or amino-tris-(methylenephosphonic acid) ("ATMP") and/or their lithium salts, solid carriers, abrasives, colorants or odorants.

A method of cleaning concrete utilizing the alkaline, substantially- or completely sodium-free cleaning composition of the instant invention involves applying an efficacious amount of said cleaning composition to the dirty concrete surface by spraying, pouring, or otherwise contacting the cleaning composition with the soiled concrete substrate, and after waiting an efficacious amount of time, either rinsing off said cleaning composition with the soil to be removed, optionally with pressurized water, and also optionally vacuuming up the residuals or alternatively, scrubbing the concrete with a brush, broom, cloth or mop, (mechanically or manually) followed by rinsing and/or vacuuming as above, and optionally repeating this process 1-3 times.

A similar method may be used to remove rubber from concrete or mixed concrete/asphalt runways utilizing the alkaline, substantially- or completely sodium-free cleaning composition of the instant invention, by applying an efficacious amount of said cleaning composition to the soiled concrete surface by spraying, pouring or otherwise contacting the cleaning composition with the soiled concrete substrate, and after waiting an efficacious amount of time, either rinsing off said cleaning composition with high pressure water, or alternatively, scrubbing the concrete with a brush or broom, (mechanical or manual), followed by rinsing, optionally with pressurized water, and also optionally vacuuming up the residuals, and optionally repeating this process 1-3 times.

A similar method may also be used to remove paint from concrete utilizing the alkaline, substantially- or completely sodium-free cleaning composition of the instant invention, applying an efficacious amount of said cleaning composition to the painted concrete surface by spraying, pouring or otherwise contacting the cleaning composition with the soiled concrete substrate, and after waiting an efficacious amount of time, either rinsing off said cleaning composition with the paint that has been removed, optionally with pressurized water, or alternatively, scrubbing the concrete with a brush, broom, or mop (mechanical or manual), followed by rinsing, optionally with pressurized water, and optionally repeating this process 1-3 times.

EXAMPLES

The following examples will demonstrate useful cleaning agent combinations and methods for use thereof.

Example 1

General-Purpose Concrete Cleaner

A concrete cleaner containing the following weights was blended:

| | |
|---|---|
| water | 80 parts |
| Ethylene diamine tetra acetic acid | 0.2 parts |
| Lithium hydroxide monohydrate | 5.0 parts |
| nonylphenol-9.5-mole ethoxylate | 2.0 parts |
| ethylene glycol monobutyl ether | 4.0 parts |
| caprylo-amphopropionic acid | 5.1 parts |

This solution was clear at room temperature, and showed good cleaning action on old oily concrete.

Example 2

Paint Strippers

The following paint stripper formulations were blended. Note that formulation B includes a thickening agent as well as solvents, surface active agents and a coupling agent.

| | A | B |
|---|---|---|
| water | 16.7 parts | 75 parts |
| Ethylene diamine tetra acetic acid | 0.02 parts | 0.02 parts |
| Citric acid | — | 0.2 parts |
| Lithium hydroxide monohydrate | 3.7 parts | 20 parts |
| high-purity furfuryl alcohol | 2.0 parts | — |
| "Tergitol 15-S-9" ethoxylated secondary alcohol | 0.2 parts | — |
| Burlington Chemical Defoamer 86 | — | 0.2 parts |
| coco-amphopropionic acid | 1.9 parts | — |
| diethylene glycol monobutyl ether | — | 2.0 parts |
| caprylo-amphopropionic acid | — | 7.0 |
| polymeric thickener ("Carbopol 690") | — | 2.0 parts |
| RESULT | Thin liquid | Viscous pasty liquid |

Both of these formulations effectively removed industrial enamel from concrete after four hours of exposure followed by rinsing and wiping with a wet rag.

Example 3

Runway Rubber Removers

The following formulations were stable, containing the indicated parts of each component.

| | A | B |
|---|---|---|
| water | 80 parts | 80 parts |
| Ethylene diamine tetra acetic acid | 0.2 parts | 0.2 parts |
| Lithium hydroxide monohydrate | 10 parts | 5.0 parts |
| nonylphenol-9.5-mole ethoxylate | 2.0 parts | 1.3 parts |
| ethylene glycol monobutyl ether | 4.0 parts | 6.0 parts |
| caprylo-amphopropionic acid | 5.1 parts | — |
| coco-amphopropionic acid | — | 4.3 parts |

These cleaners effectively removed runway rubber from an asphalt runway, cleaner "A" removing approximately 20-40% and cleaner "B" removing 30-50% of the runway rubber after 10 minutes of exposure followed by 10 back-and-forth "scrub cycles" using a nylon vegetable brush with significant pressure applied by hand, followed by rinsing with an excess of water. It is noteworthy that utilizing water alone under the same circumstances removed little or substantially none of the rubber.

Example 4

Powdered Cleaners

The following formulations show the usefulness of formulations with or without a special powder for carrying liquid ingredients in powders.

| | A | B |
|---|---|---|
| Lithium hydroxide monohydrate | 30 parts | 10 parts |
| sodium acid pyrophosphate | 20 parts | — |
| lithium carbonate | 15 parts | 70 parts |
| "Microcell E" (Celite Corp) | — | 8.0 parts |
| citric acid | — | 3.0 parts |

The powders were mixed, then the following were premixed and added to the powder with good agitation:

| | A | B |
|---|---|---|
| nonionic surfactant | 1.3 parts | 10.0 parts |
| dodecyl benzene sulfonic acid | 5.0 parts | 3.0 parts |
| water | 3.3 parts | — |

The nonionic surfactants were nonylphenol-9.5-mole ethoxylate and "Tomadol" 23-6.5 linear alcohol ethoxylate, respectively for A and B. The resultant powders showed good cleaning action on concrete when partially or completely dissolved.

Example 5

Examples Showing a Range of Surfactants and Polymers

The following blends contained the following ingredients, and were useful to varying degrees for particulate soils and/or oily soils on concrete. All proportions are parts by weight. The relative results for cleaning shop dirt or oil from dirty concrete are listed below, at the bottom of each column. This example indicates that a variety of polymers, cationic and/or anionic surfactants can be used to make cleaning compositions containing only lithium-based alkalies.

| | A. | B. | C. | D. | E. | F. | G. | H. |
|---|---|---|---|---|---|---|---|---|
| $LiOH \cdot H_2O$ | 4.75 | 4.75 | 4.75 | 4.75 | 4.75 | 4.75 | 4.75 | 4.75 |
| Nonyl phenol 9.5-moles EO | 1.0 | 1.0 | 1.0 | 1.0 | 1.0 | 1.0 | — | 1.0 |
| Ethylene glycol monobutyl ether | 4.0 | 4.0 | 4.0 | 4.0 | 4.0 | 4.0 | — | 4.0 |
| Surfactant (1.0 Parts) | — | S-1 | S-2 | — | — | — | S-3 | — |
| Polymer/other | — | — | — | P-1 | P-2 | P-3 | — | BPS |
| Water (Each to 100 g) | QS | QS | QS | QS | QS | QS | QS | QS |

Results:

| | | | | | | | | |
|---|---|---|---|---|---|---|---|---|
| Dirt | G | F/P | F/P | G/E | G/E | G/E | G/E | G/E |
| Oil | F | F/P | F/P | G/F | G/E | G/E | G/E | G/F |

Note that Example 3A was also evaluated with this series, and performed "G" on the dirt, and "G/F" on the oily soiled concrete. Note also that all performed better than water alone.

Where S-1 is "Barlox 10OS", isodecyl dimethyl amide oxide, manufactured by Lonza Corporation, S-2 is "Q-17-2", an ethoxylated (2 moles of ethylene oxide) alkyl methyl quaternary ammonium chloride manufactured by Tomah Products, Inc., S-3 is "Tomakleen TFR" surfactant blend, also by Tomah Products, Inc., P-1 is "BSI-97" polyacrylic acid, manufactured by Buckman Industries, Inc., P-2 is "Sokolan HP-53" poly-(vinyl pyrrolidone), manufactured by BASF Corporation, P-3 is "Brisperse 891", manufactured by Rhodia Corporation, "BPS" is BPS-319, a phosphonic acid blend manufactured by Buckman Industries, Inc., and "QS" means that quantity of water that was sufficient to bring the total weight to 100 grams. The evaluations were either Excellent "E", Good "G", Fair "F", Poor "P" or combinations such as G/E "Good to Excellent". The examples show that choice of polymer, additive or surfactant combination can have an impact on the type of soil and extent of its removal, and provide a starting basis for further optimization.

Example 6

The following polymers, sequestrants and surfactants and/or additives were combined at approximately 0.4% (or more) by weight into 10% solutions of lithium hydroxide monohydrate without showing precipitation, and therefore indicating that this class of ingredients in general would be good additions to cleaning formulations. These materials are either in or in addition to types of ingredients that have been used in the examples above.

Phosphonates:

Dequest 2006,-2010 and -2054 (Monsanto Corporation)

Briquest 221-50A (Albright and Wilson—now Rhodia)

PBS-319 (Buckman Laboratories, Inc.)

Polymers:

Aqua Treat AR-232,-540,-980 (Alco Chemical Company)

BSI-75,-78,-97,-99, 361 (Buckman Laboratories, Inc.)

Goodrite K-732 (B.F. Goodrich, Inc.)

Brisperse 891 (Rhodia Corporation)

Bricorr 288 (Rhodia Corporation)

Sequestrants/Builders:

tetrasodium pyrophosphate sodium acid pyrophosphate sodium tripolyphosphate hypophosphorous acid borax Other:
- alkyl amphopropionates:
  - Colateric CYA-35 (caprylo)
  - Colateric CA-35 (coconut)
  - Colateric TA-35 (tallow)
  - Colateric MSC (blend)
- alkyl amphodipropionate:
  - coco imidazoline amphodipropionate, lithium salt
- alkyl ethoxylate phosphate esters:
  - Np-10 phosphate ester.

That which is claimed:

1. A method of cleaning an aggregate-containing substrate to at least partially remove a soiling substance from the substrate while avoiding contributing to any alkali-silicate reaction within the substrate, said method comprising:

a. applying to said substrate a cleaning composition comprising:
   i. about 1-10% by weight of an alkaline salt selected from the group consisting of lithium hydroxide, hydrates of lithium hydroxide, lithium oxide, lithium carbonate, and combinations thereof; and
   ii. a lithium-containing surfactant;
   the cleaning composition being expressly free of any sodium ions and thus excluding any component that contributes to alkali-silicate reaction within the substrate;

and b. removing at least a portion of said cleaning composition along with at least a portion of said soiling substance from said substrate.

2. The method of claim 1, further comprising repeating said applying step and said removing step 1 to 3 times.

3. The method of claim 1, further comprising allowing the cleaning composition to remain on the substrate for a predetermined amount of time prior to said removing step.

4. The method of claim 1, wherein said applying step comprises spraying or pouring the cleaning composition onto the substrate.

5. The method of claim 1, wherein said removing step comprises rinsing the cleaning composition from the substrate.

6. The method of claim 5, wherein said rinsing step comprises the use of pressurized water.

7. The method of claim 1, wherein said removing step comprises vacuuming the cleaning composition from the substrate.

8. The method of claim 1, wherein said removing step comprises a combination of removal methods.

9. The method of claim 1, further comprising scrubbing at least a portion of the substrate with the cleaning composition thereon prior to said removing step.

10. The method of claim 9, wherein said scrubbing step comprises scrubbing with a device selected from the group consisting of brushes, brooms, cloths, mops, and combinations thereof.

11. The method of claim 9, wherein said scrubbing step comprises mechanical or manual scrubbing.

12. The method of claim 9, comprising repeating said applying step, said scrubbing step, and said removing step 1 to 3 times.

13. The method of claim 9, comprising repeating said scrubbing step and said removing step 1 to 3 times.

14. The method of claim 1, wherein the soiling substance comprises a substance selected from the group consisting of oil, dirt, rubber, paint, and combinations thereof.

15. The method of claim 1, wherein said cleaning composition further comprises one or more solvents.

16. The method of claim 15, wherein the solvents are selected from the group consisting of:

a) a glycol ether solvent or mixture of solvents containing at least one alkylene-oxide-derived component selected from the group consisting of ethylene, propylene, butylene, and isobutylene oxides, wherein said glycol ether contains at least one terminal alkyl or aryl chain comprising straight-chain, branched, or aromatic groups having 1 to about 12 carbon atoms;

b) a hydrocarbon solvent or mixture of solvents selected from the group consisting of aliphatic, aromatic, and unsaturated aliphatic solvents having about 6 to about 60 carbon atoms;

c) aliphatic, aromatic, or unsaturated alcohols having about 3 to about 60 carbon atoms;

d) aliphatic, aromatic, or unsaturated ethers having about 3 to about 60 carbon atoms; and e) combination solvents comprising a combination of one or more alcohol or ether components having about 3 to about 60 carbon atoms, wherein said alcohol or ether components are aliphatic, aromatic, aliphatic/aromatic, unsaturated aliphatic, or unsaturated aliphatic/aromatic.

17. The method of claim 1, wherein the cleaning composition further comprises one or more coupling agents.

18. The method of claim 17, wherein the coupling agents are selected from the group consisting of: xylene-, toluene-, naphthalene-, or alkylnaphthalene-sulfonic acid or lithium salts thereof; fatty acid imidazoline-derived amphoterics having about 6 to about 25 carbon atoms and comprising one or more carboxylic acids selected from acetic and propionic acids or lithium salts thereof; alkyl disulfonated diphenyl oxides or free acids or lithium salts thereof, wherein the alkyl chain length is comprises about 6 to about 25 carbon atoms; alkyl or alkylaryl esters of phosphoric or polyphosphoric acid, and combinations thereof.

19. The method of claim 18, wherein the esters of phosphoric or polyphosphoric acid comprise alkyl or alkylaryl ethoxylate esters and alkyl or alkylaryl ethoxy-propoxylate esters.

20. The method of claim 1, wherein the cleaning composition further comprises one or more chelating agents.

21. The method of claim 20, wherein the chelating agents are selected from the group consisting of ethylenediamine tetra-acetic acid, ethylenediamine tri-acetic acid, gluconic acid, erythorbic acid, ascorbic acid, citric acid, boric acid, pyroboric acid, polyboric acid, anhydrous boric acid, ammonium pentaborate, pyrophosphoric acid, tripolyphosphoric acid, salts thereof, and combinations thereof.

22. The method of claim 1, wherein the aggregate containing substrate is selected from the group consisting of cementitious materials, asphalt, and combinations thereof.

23. A method of removing rubber from an aggregate-containing substrate while avoiding contributing to any alkali-silicate reaction within the substrate, said method comprising:

a. applying to said substrate a cleaning composition comprising:

i. about 1-10% by weight of an alkaline salt selected from the group consisting of lithium hydroxide, hydrates of lithium hydroxide, lithium oxide, lithium carbonate, and combinations thereof; and ii. a lithium-containing surfactant;

the cleaning composition being expressly free of any sodium ions and thus excluding any component that contributes to alkali-silicate reaction within the substrate;

and b. removing at least a portion of the cleaning composition along with at least a portion of the rubber from the substrate.

24. The method of claim 23, further comprising allowing the cleaning composition to remain on the substrate for a predetermined amount of time prior to said removing step.

25. The method of claim 23, further comprising scrubbing at least a portion of the substrate with the cleaning composition thereon prior to said removing step.

26. The method of claim 23, wherein the aggregate containing substrate is selected from the group consisting of cementitious materials, asphalt, and combinations thereof.

27. A method of cleaning an aggregate-containing substrate to at least partially remove a soiling substance from the substrate while avoiding contributing to any alkali-silicate reaction within the substrate, said method comprising:

a. applying to said substrate a cleaning composition comprising:

i. an alkaline salt that provides cations in solution; and ii. a lithium containing surfactant;

wherein the cleaning composition provides no sodium ions in solution but provides only lithium as the sole inorganic cation in solution and does not contribute to any alkali-silicate reaction within the substrate and b. removing at least a portion of said cleaning composition along with at least a portion of said soiling substance from said substrate.

28. A method of cleaning an aggregate-containing substrate to at least partially remove a soiling substance from the substrate while avoiding contributing to any alkali-silicate reaction within the substrate, said method comprising:

a. applying to said substrate a cleaning composition comprising:

i. an alkaline salt;

ii. a surfactant;

iii. a solvent comprising a glycol ether solvent or mixture of solvents containing at least one alkylene-oxide-derived component selected from the group consisting of ethylene, propylene, butylene, and isobutylene oxides, wherein said glycol ether contains at least one terminal alkyl or aryl chain comprising straight-chain, branched, or aromatic groups having 1 to about 12 carbon atoms;

iv. a coupling agent selected from the group consisting of: xylene-, toluene-, naphthalene-, or alkylnaphthalene-sulfonic acid or lithium salts thereof; fatty acid imidazoline-derived amphoterics having about 6 to about 25 carbon atoms and comprising one or more carboxylic acids selected from acetic and propionic acids or lithium salts thereof; alkyl disulfonated diphenyl oxides or free acids or lithium salts thereof, wherein the alkyl chain length is comprises about 6 to about 25 carbon atoms; alkyl or alkylaryl esters of phosphoric or polyphosphoric acid, and combinations thereof; and v. a chelating agent, wherein the chelating agent comprises ethylenediamine tetra-acetic acid;

wherein the composition is completely free of a sodium containing component and includes only lithium as the sole inorganic cation;

and b. removing at least a portion of said cleaning composition along with at least a portion of said soiling substance from said substrate.

29. A method of cleaning an aggregate-containing substrate to at least partially remove a soiling substance from the substrate while avoiding contributing to any alkali-silicate reaction within the substrate, said method comprising:

a. applying to said substrate a cleaning composition consisting essentially of:

i. about 1-10% by weight of one or more alkaline salts that provide only lithium inorganic cations in aqueous solution;

ii. one or more lithium containing surfactants;

iii. one or more optional solvents;

iv. one or more optional coupling agents; and v. one or more optional chelating agents;

wherein the composition is completely free of a sodium containing component;

and b. removing at least a portion of said cleaning composition along with at least a portion of said soiling substance from said substrate.

* * * * *